United States Patent [19]

Larson et al.

[11] Patent Number: 4,741,080

[45] Date of Patent: May 3, 1988

[54] PROCESS FOR PROVIDING VALVE MEMBERS HAVING VARIED MICROSTRUCTURE

[75] Inventors: Jay M. Larson, Marshall, Mich.; Emory Z. Pankas, Riverdale; Charles E. Pennock, Kearney, both of Nebr.; Stephen B. Caird, Belmond; Michael A. Allibone, Garner, both of Iowa; John D. Dingell, III, Marshall, Mich.; Antonio Gutierrez, Belmond, Iowa

[73] Assignee: Eaton Corporation, Cleveland, Ohio

[21] Appl. No.: 17,293

[22] Filed: Feb. 20, 1987

[51] Int. Cl.[4] ..... B21K 1/24

[52] U.S. Cl. ..... 29/156.7 R; 123/188 AA

[58] Field of Search ..... 10/27 R, 27 E, 27 H; 29/156.7 R; 72/364, 377; 123/188 AA; 148/11.5 N, 12.7 N, 12 R, 12.3, 320, 325, 326, 328, 410, 902; 251/368

[56] References Cited

U.S. PATENT DOCUMENTS

| | | | |
|---|---|---|---|
| 1,351,949 | 9/1920 | Fuchs | 10/27 E |
| 2,162,063 | 6/1939 | Crawford | 123/188 AA |
| 2,637,672 | 5/1953 | Losco et al. | 148/12.3 |
| 3,319,321 | 5/1967 | Danis | 29/156.7 R |
| 3,795,510 | 3/1974 | Davies et al. | 123/188 AA X |
| 4,073,474 | 2/1978 | Hashimoto et al. | 123/188 AA X |
| 4,547,229 | 10/1985 | Larson et al. | 148/134 |
| 4,657,964 | 6/1987 | Allison | 29/156.7 R |

FOREIGN PATENT DOCUMENTS

| | | | |
|---|---|---|---|
| 121444 | 4/1943 | Australia | 148/12 R |

*Primary Examiner*—P. W. Echols
*Assistant Examiner*—Andrew E. Rawlins
*Attorney, Agent, or Firm*—D. A. Rowe; A. E. Chrow

[57] ABSTRACT

A process for providing an engine valve (2) with varied microstructure grain size is provided. The process includes the steps of: providing a slug (4) of suitable metallic valve composition having a grain size of less than about A.S.T.M. 8; solution heat treating slug (4) to provide a larger grain size and to substantially dissolve carbonitride stringers if present; and forging the solution heat treated slug (4) in a manner that provides a substantially uniformly distributed A.S.T.M. grain size of about 1 to about 7 in a central region beneath the combustion face of head (14) of valve (2) while cold working a seat face (16) on head (14) and extruding the stem (10) of valve (2) such that its microstructure grain size is less than about A.S.T.M. 8.

9 Claims, 3 Drawing Sheets

PROCESS FOR PROVIDING VALVE MEMBERS HAVING VARIED MICROSTRUCTURE

INTRODUCTION

This invention relates generally to a process for controling microstructure of a valve member and more particularly to a process for providing the head and stem portions of an engine valve member with different microstructure grain sizes and harnesses advantageously tailored for engine applications.

BACKGROUND OF THE INVENTION

Valve members for use in internal combustion engines, particularly diesel engines, are expected to perform for long periods of time under rigorous conditions. Generally, the head portion, including the seat face and the combustion face of the valve member exposed to the combustion chamber, is required to resist a variety of factors including high temperature, high pressure, corrosion, fatigue, erosion and wear while the stem portion of the valve member is required to possess high strength, wear and fatigue characteristics at temperatures lower than the temperature to which the head portion combustion face is exposed.

Recently, efforts have been made to provide the head and stem portions with the properties described by controlling the microstructure of metallic compositions from which the valve member is made such that the head portion of the valve member is provided with a generally coarse grain size and the stem portion is provided with a generally fine grain size that is smaller than the coarse grain size of which an exemplary method is disclosed in U.S. Pat. No. 4,547,229 assigned to the assignee of the present invention and the disclosure of which is included herein by reference.

The aforementioned method, however, relies upon selective solution heat treatment to enlarge the grain size only in the head portion requiring expensive apparatus to shield the stem portion from the solution head treating temperature whereas the present invention is operative to use less expensive more conventional equipment to provide the microstructure grain size characteristics desired as well as providing the seat face of the head portion with improved resistance to wear.

SUMMARY OF THE INVENTION

Accordingly, it is an object of this invention to provide a process for making a valve member suitable for use in an internal combustion engine.

It is another object of this invention to provide a process for making a valve member that is particularly adapted for use in a diesel engine.

It is yet another object of this invention to provide a process for making a valve member having a microstructure characterized by having a generally coarse grain structure in the head portion thereof and a generally fine grain size in the stem portion thereof.

It is still another object of this invention to provide a valve member for an engine having a microstructure characterized by the head portion having improved fatigue and creep resistance at high temperature, the seat face having improved wear resistance at high to moderate temperatures and the stem having improved fatigue and wear resistance at moderate to low temperatures.

BRIEF DESCRIPTION OF SOME PREFERRED EMBODIMENTS

The process of the invention is applicable to any metallic valve material that is suitable for the particular application involved and which is forgeable and possesses a microstructure that responds to solution heat treating. As will be recognized to those skilled in the art, such materials include the Austenitic steels of the S.A.E. EV series such as 21-2N; 21-4N; and 23-8N and similar compositions. The invention is also applicable to solution heat treatable steels of the S.A.E. HEV series, nickel base alloys such as those sold under the trade designations Inconel, Waspalloy, Nimonic and similar compositions all of which are hereinafter described generally as "metallic valve" compositions.

Figure 1:
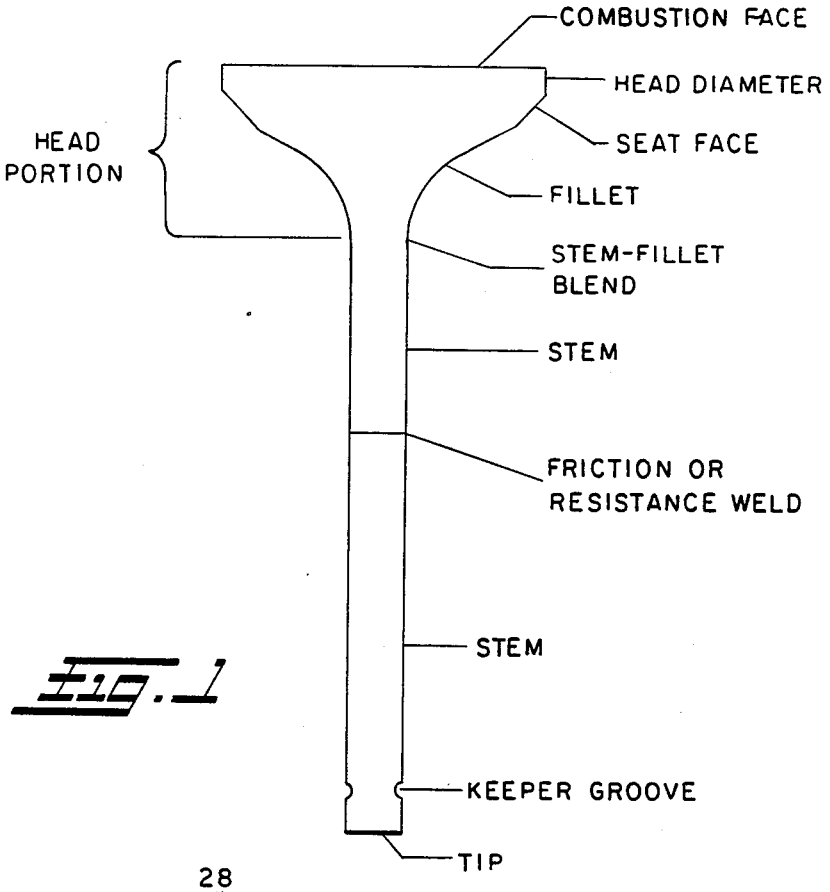
FIG. 1 shows a side view of a typical engine valve depicting nomenclature commonly used to identify various portions of the valve.

Nomenclature commonly used to identify various locations on an engine valve is shown in FIG. 1 in which the head portion includes: a "combustion face" that faces inwardly into the engine combustion chamber; a "seat face" which is likewise located in but faces away from the combustion chamber and is the peripheral surface about the heat portion that engages the engine block or insert if such is included; and the "fillet" which commonly tapers concavely inwardly to join the head with the "stem" of the valve at the "stem-fillet blend" which is often extended into a longer stem which is a "fricton" or "resistance welded thereto" and ends in a "tip" adjacent to which a "keeper groove" is commonly included for connecting the valve to an engine member operative to reciprocate the valve synchronously with the engine combustion sequence. If the valve stem is extended, it is the upper stem of FIG. 1 that is provided by the process of the invention. The head and stem portions are generally cyindrical with the head portion having a diameter substantially greater than the stem portion. As hereinafter used, the term "final diameter" does not necessarily means "finished diameter" since subsequent machining may be employed to provide the finished diameter subsequent to making the valve by the process of the invention.

Figure 2:
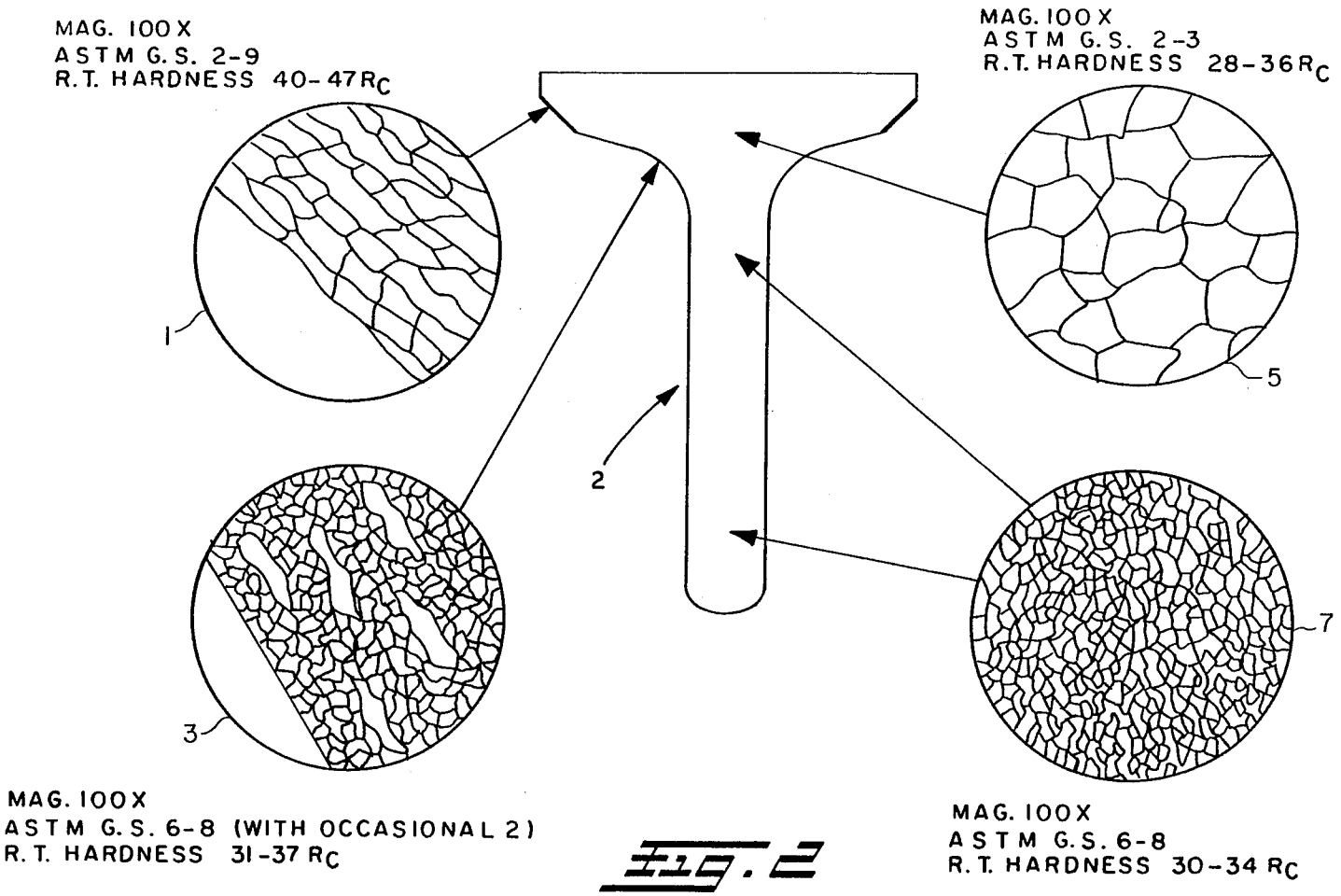
FIG. 2 shows a graphic description of microstructure shape and relative grain size as well as hardness at referenced locations on an engine valve made by the process of the present invention.
Figure 3:
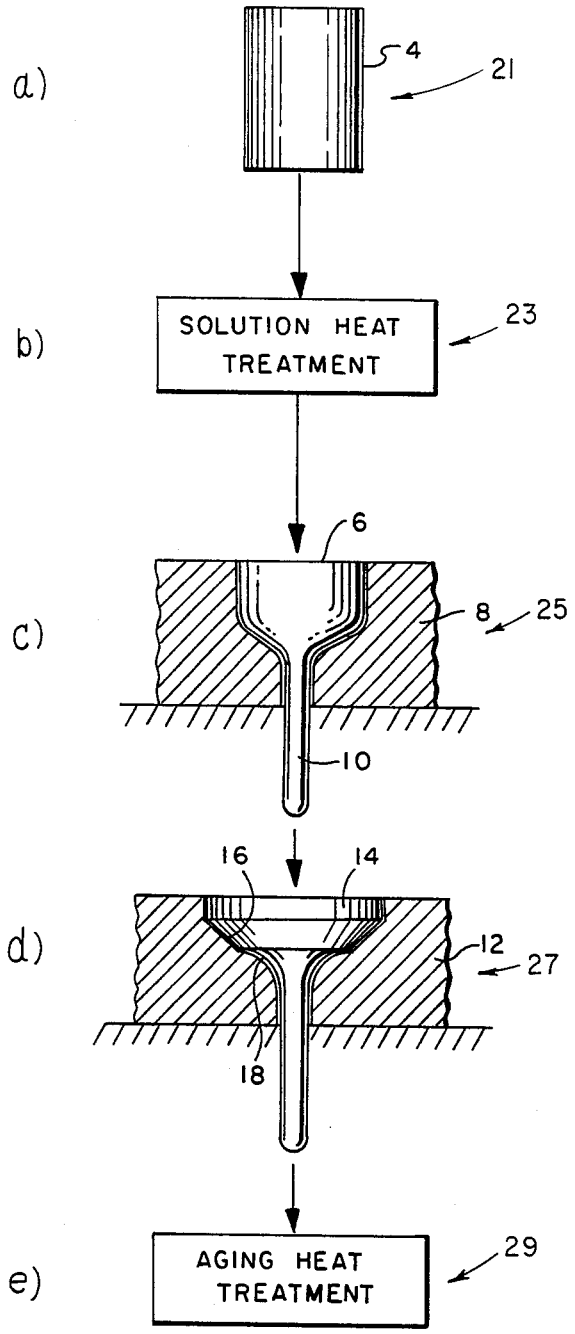
FIG. 3 shows a block diagram of a preferred embodiment of the process of the invention operative to provide the engine valve of FIG. 2.

By way of example, the process of the invention as hereinafter described with respect to FIGS. 2 and 3, is conducted upon Nimonic 80A whose composition is described in following Table I and which is found particularly advantageous for use in diesel engine applications.

TABLE I

| CONSTITUENT | Typical (% by weight) |
|---|---|
| Carbon | .05 |

TABLE I-continued

| CONSTITUENT | Typical (% by weight) |
|---|---|
| Manganese | .5* |
| Phosphorus | .015* |
| Sulfur | .015* |
| Silicon | .5* |
| Chromium | 19.0 |
| Titanium | 2.3 |
| Aluminum | 1.4 |
| Cobalt | 2.0* |
| Iron | 2.0* |
| Nickel | Balance |

*(up to about)

The effect upon microstructure and hardness at various locations on a valve member 2 made from the composition of Table I by the process of the invention is shown in FIG. 2 for which the initial average A.S.T.M. grain size of slug 4 of FIG. 3 was about 2–3 distributed substantially uniformly throughout.

As shown in FIG. 2, the process of the invention provides a valve made from the composition of Table I having: a generally uniformly equiaxed grain size of 2–3 and an ambient hardness of 28–36 Rc in the head portion beneath the combustion face; as referenced by numeral 5 large elongated grains surrounded by smaller grains providing an A.S.T.M. grain size of 2–9 and an ambient hardness of 40–47 Rc at the seat face; as referenced by numeral 1 a minority of elongated grains having an A.S.T.M. grain size of about 2 surrounded by smaller equiaxed grains having an A.S.T.M. grain size 6–8 and an ambient hardness of 31–37 Rc at the fillet; as referenced by numeral 3 and small equiaxed grains in the stem portion having an A.S.T.M. grain size of 6–8 distributed substantially uniformly throughout the stem portion providing an ambient hardness of 30–34 Rc as referenced by numeral 7.

The process of the invention hereinafter described also enables eliminating the problem of pitting on the valve head combustion face arising from carbonitride stringers commonly associated with valves made for example from 21-2N material having the composition shown in following Table II and illustrated in FIG. 4 where combustion face 20 of a valve head having a seat face 22 and a fillet portion 24 includes pitting 28 arising from carbonitride stringers 26.

TABLE II

| CONSTITUENT | Typical (% by weight) |
|---|---|
| Carbon | .55 |
| Manganese | 8.25 |
| Silicon | .17 |
| Phosphorus | .05* |
| Sulfur | .04* |
| Chromium | 20.7 |
| Nickel | 2.0 |
| Nitrogen | .3 |
| Iron | Balance |

*(up to about)

Note that the composition of Table II includes carbon and nitrogen which characteristically promotes formation of carbonitride stringers in valves made by conventional prior art processes.

Figure 4:
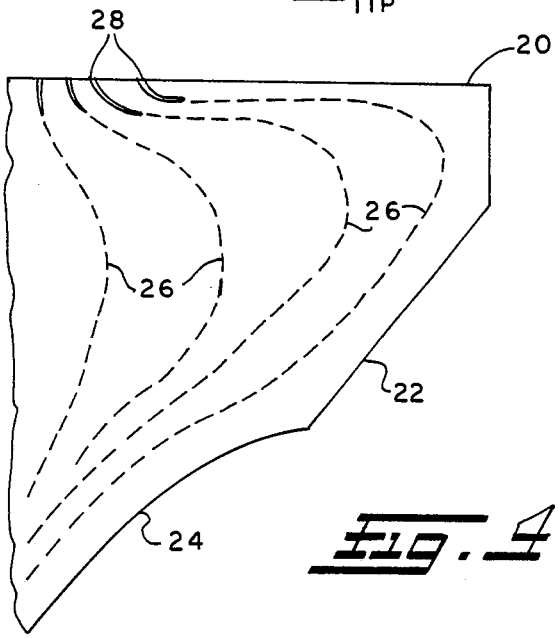
FIG. 4 shows a graphic description of a portion of an engine valve head made by a conventional process and having a pitted combustion face arising from carbonitride stringers.

Such stringers are commonly found in austenitic steel engine valves and lead to the pitting on the combustion face previously described for FIG. 4. The face pitting may arise from tearing at the combustion face during forging or by entrapped forging lubricant forced between the carbonitride stringers and the metal matrix and which can be further enlarged by preferential oxidation during subsequent heat treating of the forged valve.

The process of the invention shown in FIG. 3 enables economic production of valves made from commonly used metallic valve compositions having a coarse grain size of from about A.S.T.M. 1 to about 7 in the central region of the head portion beneath combustion face providing optimum high temperature fatigue and creep properties; a heavily cold worked grain structure at the valve seat providing optimum hot hardness and moderate to high temperature wear resistance; and a fine grain size of less than about A.S.T.M. 7 in the stem portion providing optimum moderate to low temperature fatigue, impact, and wear properties.

Broadly, the process of the invention providing the above includes the steps:

(1) providing a generally cylindrical slug 4 in step (a) referenced by numeral 21 made from a metallic valve composition predetermined suitable for use in engine valve applications having an initial fine grain size of less than about A.S.T.M. 8 distributed substantially uniformly therethrough;

(2) solution heat treating the slug of step (a) at a temperature and for a time sufficient to provide a coarse grain size distributed substantially uniformly therethrough that is larger than the initial grain size; in step (b) referenced by numeral 23 and (3) forging the slug of step (b) into the valve such that the central heat portion substantially retains the coarse grain size of step (2) whilst the seat face is worked to provide optimum high temperature resistance and moderate to high temperature wear resistance and the stem portion is extruded such that the grains are recrystallized and altered to a fine grain size of less than about A.S.T.M. 7 distributed substantially uniformly therethrough.

Preferably, the process of the invention further includes a step (e) of heating aging subsequent to the forging of step (3) for a time and at a temperature predetermined to optimize hardness and strength and hardness for the grains associated with the head and stem portions as referenced by numerals 29.

The forging of step (3) is preferably done in two steps shown as forge extrusion step (c) and forge upset step (d) in FIG. 3 as referenced by numerals 25 and 27 respectively afterwhich is preferably included the above described heat aging step. Typically, the reduction ratio between the slug and forge extrusion step (c) is about 3 to 1 and between forge extrusion step (c) and forge upset step (d) about 1.8 to 1.

In forge extrusion step (c), the solution heat treated slug 4 of step (b) is forged at a predetermined temperature in a first die 8 that is adapted to partially form the heat portion of the valve but of smaller head diameter and only partially forming fillet portion 18 and seat face 16 whilst extruding the stem portion 10 therefrom in substantially its final form and thence in step (d) forging the partially forged product of step (c) in die 12 at a predetermined reduced temperature from the temperature of step (c) to decrease the diameter of head portion 14 to that desired whilst completing fillet portion 18 and seat face 16 and in particular cold working seat face 16 to provide the optimum properties thereat previously described.

Generally the solution heat treatment of step (b) for super alloys such as Nimonic 80A is done at a temperature of from about 1800° F. to about 2300° F. for about 1 hour for metallic valve compositions at the low end of the temperature spectrum and for as little as one minute for those at the high end of the temperature spectrum.

In the event the composition is of the type forming carbonitride stringers such as 21-2N, solution heat treating is preferably done at a temperature of from about 2100° F. to about 2300° F. for a period sufficient to dissolve the stringers.

Even more effective dissolving of carbonitride stringers is accomplished when the solution heat treating process is first conducted in air or protective atmosphere at about 2250° F. for about 5 minutes and then at a lower temperature of about 2150° F. for about one hour.

For valve compositions such as 21-2N previously described, it has been found solution heat treating in step (b) between 1900° F. and 2125° F. for a minimum of 30 minutes is highly effective in spherodizing the carbonitride stringers which greatly reduces combustion face pitting.

The solution heat treating step can be conducted by heating the valve composition in either a suitable gaseous or liquid medium by conductive, inductive, radiative or other heating means well known to those skilled in the art of solution heat treating metallic compositions.

The heat aging step after forging is preferably conducted in air for compositions such as 21-2N previously described at a temperature of about 1350° F. to about 1550° F. for about 10 to abcut 16 hours and for valve compositions such as Nimonic 80A in two steps as hereinafter described.

For illustrative purposes, the valve made of Nimonic 80A shown in FIG. 2 having the composition shown in Table I was made by the process of the invention by providing the wrought cylindrical slug of step (a) by slicing a wrought cylinder and then:

(b) solution heat treating the slug at a temperature of from about 2000° F. to about 2100° F. for about one hour;

(c) forge extruding the product of step (b) in a die adapted to partially form the valve head portion and to enable extrusion of the stem portion in substantially its final form at a temperature of about 2000° F. to about 2100° F.;

(d) forge upsetting the product of step (c) in a die adapted to finish forming the valve at a temperature of about 1900° F. to about 2000° F.; and (e) heat aging the valve of step (d) at a temperature of from about 1375° F. to about 1400° F. for about four hours and then air cooling and thence heat aging the valve in air at a temperature of about 1175° F. to about 1225° F. for about four hours.

Preferably, the product of step (b) is air cooled to the temperature required for forge extrusion step (c) and cooled in vermiculite after step (d) to the air aging temperature described for step (e) and may also be air cooled after step (c) if desired.

Many modifications and variations of the invention will be apparent to those skilled in the art in light of the foregoing disclosure. Therefore, it is to be understood that, within the scope of the appended claims, the invention can be practical otherwise as specifically disclosed and described.

What is claimed is:

1. A process for providing an engine valve from an iron or nickel based metallic valve composition having a microstructure responsive to solution heat treating, said valve of the type having a generally cylindrical head portion and a fillet portion tapering concavely inwardly from the head portion to a generally cylindrical stem portion with the head portion having a combustion face and a seat face disposed peripherally about the head portion such that the head portion is provided with a central region beneath the combustion face having a generally uniformly distributed A.S.T.M. grain size of from about 1 to about 7 for optimum high temperature creep and fatigue characteristics, the seat face is worked to provide moderate to high temperature wear resistance, and the stem portion has a generally uniformly distributed fine A.S.T.M. grain size of less than about 8 for optimum low temperature fatigue, impact and wear characteristics, and said process including the steps of:

(a) providing a generally cylindrical slug made from the composition having an initial fine A.S.T.M. grain size of less than about 8 distributed substantially uniformly throughout;

(b) solution heat treating the slug of step (a) at a temperature of from about 1900° F. to about 2300° F. for a time sufficient to provide a coarse grain size distributed substantially uniformly throughout that is larger than the initial grain size; and (c) forging the slug of step (b) such that the central head portion region substantially retains the coarse grain size of step (b) whilst the seat face is worked to provide the moderate to high temperature wear resistance and the stem portion is extruded such that the grain size is recrystallized and altered to the fine grain size of less than A.S.T.M. 7 distributed substantially uniformly throughout.

2. The process of claim 1 wherein the forging of step (c) comprises the steps of:

forge extruding the slug of step (b) at a predetermined temperature in a die adapted to partially form the head portion but of smaller diameter than the final diameter thereof and to partially form the seat face and fillet portion and to extrude the stem portion therefrom in substantially final form; and forge upsetting the partially formed forge extruded product at a predetermined temperature lower than the forge extruded temperature in a die adapted to provide the valve member by increasing the diameter of the head portion to the final diameter thereof whilst providing and cold working the seat face in conjunction with providing the fillet portion.

3. The process of claim 1 including a step of heat aging subsequent to the forging of step (c) at a temperature and for a time predetermined to enhance the strength and hardness of the valve.

4. The process of claim 1 or 2 wherein the composition of the slug of step (a) includes carbonitride stringers.

5. The process of claim 2 wherein the forge extruding temperature is from about 2000° F. to about 2100° F. and the forge upset temperature is from about 1900° F. to about 2000° F.

6. The process of claim 3 wherein the heat aging is conducted at a first predetermined temperature for a predetermined period of time and thence at a second predetermined temperature that is lower than the first temperature for a predetermined period of time.

7. A process for making an engine valve from an iron or nickel based metallic valve composition having a microstructure responsive to solution heat treating, said valve of the type having a generally cylindrical head portion and a fillet portion tapering concavely inwardly from the head portion to a generally cylindrical stem portion with the head portion having a combustion face and a seat face disposed peripherally about the head portion such that the head portion is provided with a central region beneath the combuston face having a generally uniformly distributed A.S.T.M. grain size of from about 1 to about 7 for optimum high temperature and fatigue characteristics, the seat face is worked to provide moderate to high temperature wear resistance, and the stem portion has a generally uniformly distributed A.S.T.M. grain size of less than about 8 for optimum low temperature and fatigue, impact and wear characteristics, and said process including the steps of:

(a) providing a generally cylindrical slug made from the composition having an initial fine A.S.T.M. grain size of less than about 8 distributed substantially uniformly throughout;

(b) solution heat treating the slug of step (a) at a temperature of about 1900° F. to about 2300° F. for a time sufficient to provide a coarse grain size distributed substantially uniformly throughout that is larger than the initial grain size;

(c) forge extruding the slug of step (b) at a predetermined temperature in a die adapted to partially form the head portion but of smaller diameter than the final diameter thereof and to partially form the seat face and fillet portion and to extrude the stem portion therefrom in substantially final form;

(d) forge upsetting the product of step (c) at a predetermined temperature lower than the temperature of step (c) in a die adapted to provide the valve member by increasing the diameter of the head portion to the final diameter thereof whilst providing and cold working the seat face in conjunction with providing the fillet portion; and (e) heat aging the valve of step (d) at a temperature for a time predetermined to enhance the strength and hardness thereof.

8. The process of claim 7 wherein the metallic valve composition of the slug of step (a) includes carbonitride stringers.

9. The process of claim 7 wherein the heat aging of step (e) is first conducted at a first predetermined temperature for a predetermined time and thence at a second predetermined temperature that is lower than the first predetermined temperature for a predetermined period of time.

* * * * *